US006308363B1

(12) United States Patent
Lino et al.

(10) Patent No.: US 6,308,363 B1
(45) Date of Patent: Oct. 30, 2001

(54) MODULAR MULTISIZE BIDIRECTION SCRAPING DEVICE

(75) Inventors: Antonio Carlos Ferreira Lino, Rio de Janeiro; Enio Costa Nunes, Niterói; Fernando Borja Pereira, Rio de Janeiro, all of (BR)

(73) Assignee: Petroleo Brasileiro S.A. - Petrobras (BR)

( * ) Notice: Subject to any disclaimer, the term of this patent is extended or adjusted under 35 U.S.C. 154(b) by 0 days.

(21) Appl. No.: 09/329,240

(22) Filed: Jun. 10, 1999

(30) Foreign Application Priority Data

Jun. 23, 1998 (BR) ..... 9802190

(51) Int. Cl.[7] ..... B08B 9/04
(52) U.S. Cl. ..... 15/104.061
(58) Field of Search ..... 15/3.5, 104.061

(56) References Cited

U.S. PATENT DOCUMENTS 1,516,880 11/1924 Bowman .
2,281,918 * 5/1942 Constant .
5,600,863 * 2/1997 Curran ..... 15/104.061
6,014,789 * 1/2000 Knapp ..... 15/104.061

FOREIGN PATENT DOCUMENTS

2448608 * 4/1976 (DE) ..... 15/104.061
2801378 * 7/1979 (DE) ..... 15/104.061
3818246 * 12/1989 (DE) ..... 15/104.061
859032 * 1/1961 (GB) ..... 15/104.061
981 649 1/1965 (GB) .
1423132 * 1/1976 (GB) ..... 15/104.061

* cited by examiner

*Primary Examiner*—Randall E. Chin
(74) *Attorney, Agent, or Firm*—Nixon & Vanderhye PC

(57) ABSTRACT

The present invention relates to a device for scraping the inner walls of a pipeline. The device comprises a flexible shaft, a plurality of groups of flexible radial scraping bars which are spaced apart and offset angularly so that the said bars are able to scrape substantially the entire inner surface of the said pipeline, and at least one flexible sealing module.

21 Claims, 5 Drawing Sheets

MODULAR MULTISIZE BIDIRECTION SCRAPING DEVICE

FIELD OF THE INVENTION

The present invention relates to a device for scraping the inner walls of a pipeline. More particularly, the present invention relates to a device for removing material adhering to the inner walls of a pipeline conveying a flow of petroleum.

PRIOR ART

During operation of a fluid-flow system using pipelines, material originating from the flow may adhere to the inner walls of the pipeline, which causes the area of the cross section of the pipeline to be reduced and this adversely affects the flow of fluid and, consequently, reduces the rate of fluid flow passing through the pipeline.

The rate of deposition of material on the inner walls of a pipeline will depend on a number of factors: for example the composition of the fluid, the volume flow rate, the temperature of the fluid, the geometry of the pipeline, etc. In the case of pipelines used for the flow of the petroleum production of offshore production wells, in which the petroleum has for example a high paraffin content, situations arise in which the rate of deposition is very high.

When the production wells are located in deep waters, around 1000 m or more, the thermal differential between the temperature of the petroleum which is flowing through the pipeline and which emerges at the well head at relatively high temperatures, and the temperature of the seawater, which is generally fairly low, accelerates the process of deposition of organic material on the inner walls of the pipeline. This may be exacerbated by the fact that the pipeline usually crosses relatively long distances along the seabed, up to a point where either it is connected to a manifold or it rises in order to be connected to a surface collection point.

To maintain the flow capacity of the pipeline in accordance with its original characteristics, use is regularly made of a scraping device which is passed through inside the pipeline and driven along by the actual flow. As this scraper passes through the inside of the pipeline, it removes the layers of organic material adhering to the inner walls of the pipeline, thereby maintaining the pipeline in good condition for the petroleum production to flow through.

When the internal diameter of the pipelines through which a scraping device passes is constant, there will normally be no problems concerning scraper performance when a complete scraping cycle is carried out. However, when operation involves flow systems which comprise pipelines of different diameters, which is a very common occurrence in offshore petroleum flow systems, the need arises for use to be made of scraping devices which are capable of passing through all the pipelines without a loss in scraping efficiency.

In such situations, use is made of a multisize scraping device capable of passing through sections of pipeline with different internal diameters. Scraping devices are available which are capable of passing through different sections of pipeline in which the largest diameter is approximately double the smallest diameter, and in such situations there is a significant loss of scraping efficiency.

However, situations may arise in which the scraping device becomes stuck in a certain section of pipeline, for example owing to the excessive accumulation of material. In such a situation, the most immediate possibility of recovering the scraping device consists of reversing the flow of fluid so that the scraping device is then conveyed, by the flow of fluid, in the opposite direction from its original direction of movement so that it is possible for it to be recovered at the point from where it was originally launched.

The multisize scraping devices known in the prior art do not have the characteristic of being bidirectional. There are reports of situations in which the prior art scraping devices do succeed in operating as if they were bidirectional, but results are unreliable. There is therefore a need for a multisize scraping device which is genuinely bidirectional.

As will be seen in the following description, the present invention relates to a multisize scraping device which has the characteristic of being bidirectional.

SUMMARY OF THE INVENTION

The present invention relates to a multisize bidirectional scraping device for use in removing the material adhering to the inner walls of a pipeline, said device being moved inside the pipeline, in use, by means of the actual flow of the fluid flowing through the pipeline, characterized in that the device is of modular construction and comprises:

a plurality of groups of flexible radial scraping bars which are spaced apart and offset angularly so that the said bars are able to scrape substantially the entire inner surface of the said pipeline;

a flexible shaft onto which the said plurality of groups of flexible radial scraping bars is assembled; and at least one flexible sealing module fitted on said flexible shaft of the modular multisize bidirectional scraping device.

That surface of each flexible sealing module which, in use, comes into direct contact with the inner walls of the pipeline may be coated with a layer of elastomeric material with high abrasion resistance, as a way of lengthening the service life of the sealing module.

It is also possible to open up channels in the outer surface of each flexible sealing module so that, when compressed, the flexible sealing module is better able to adapt its shape to the inner walls of a pipeline.

It is additionally possible to insert a longitudinal movement limiter inside each flexible sealing module in order to ensure it maintains a constant length, even when the modular multisize bidirectional scraping device is moving through a region of the inside of a pipeline where there is, for example, a reduction in diameter.

It is also possible to fit a plurality of further flexible radial scraping bars inside each flexible sealing module, to enhance the scraping effect.

The flexible radial scraping bars may be stiffened by means of the use, inside them, of metallic materials which have a "shape-memory" characteristic, in order to enhance the scraping effect of the scraping bars.

BRIEF DESCRIPTION OF THE DRAWINGS

The invention will now be described in greater detail in conjunction with the accompanying drawings given purely by way of example, and which form an integral part of the present specification.

In the drawings.

DETAILED DESCRIPTION OF THE INVENTION

Figure 1:
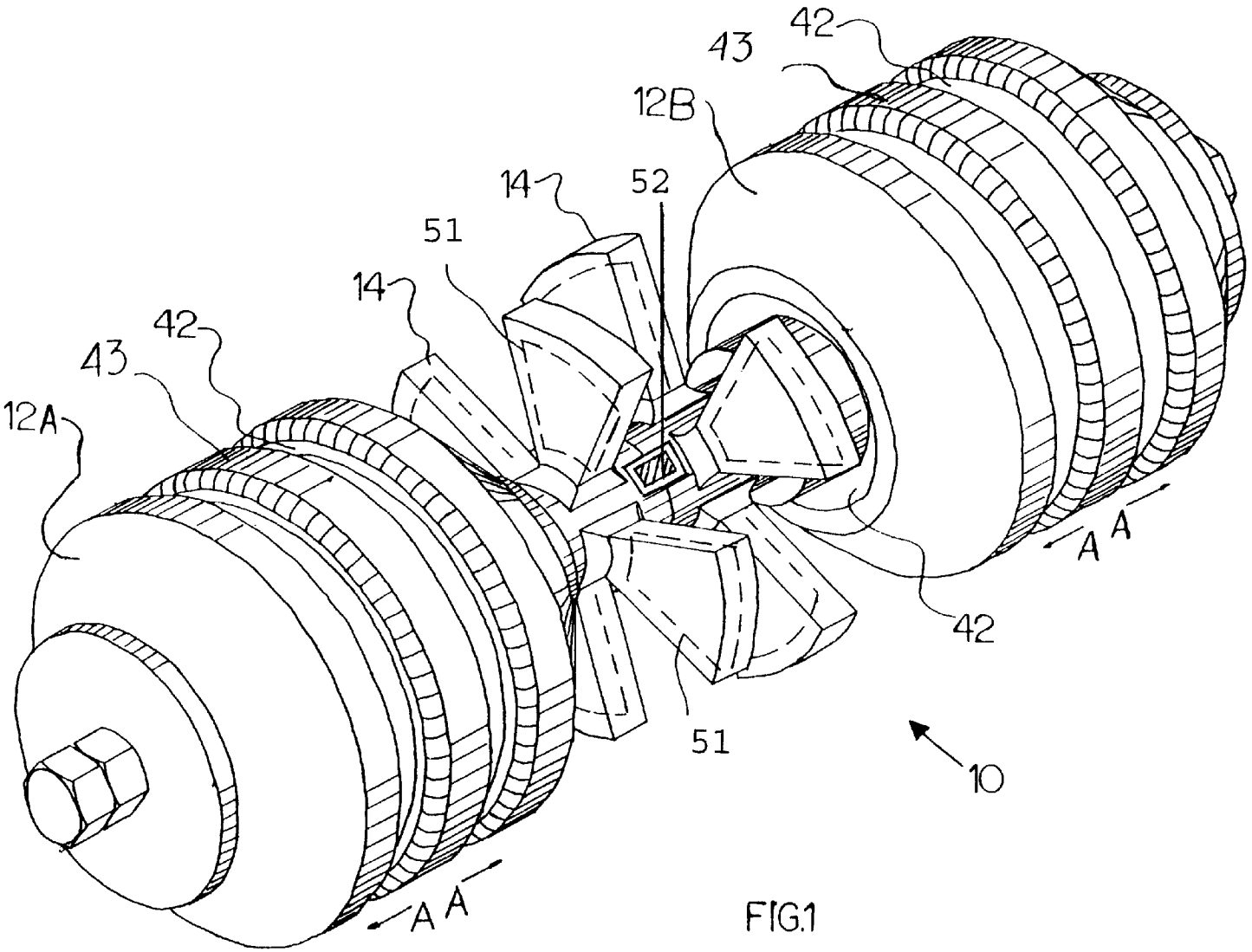
FIG. 1 is a perspective view of an embodiment of the modular multisize bidirectional scraping device of the present invention.
Figure 2:
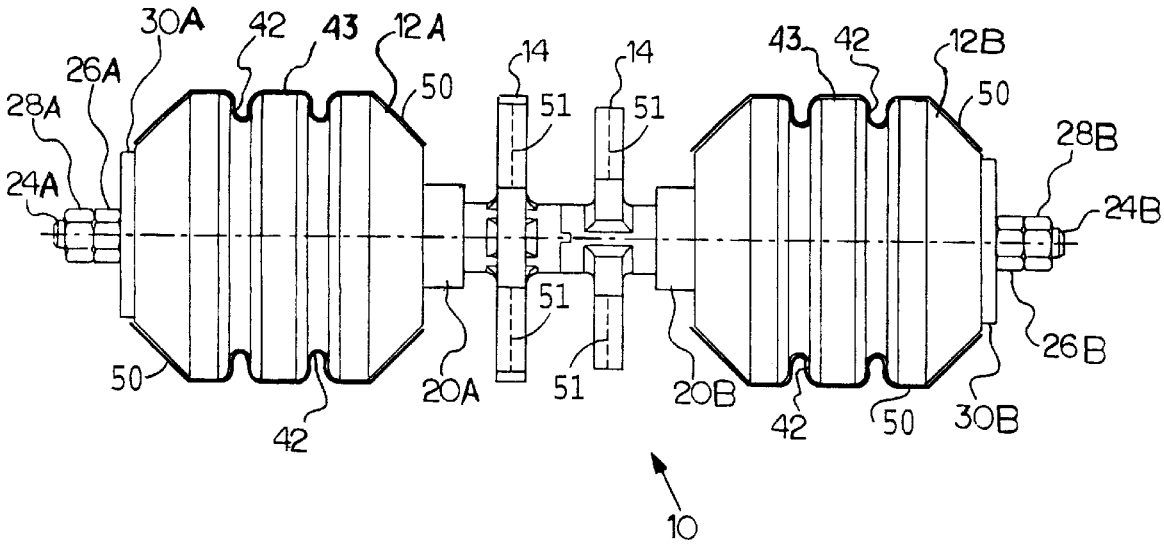
FIG. 2 is a side elevational view showing details of the assembly of the embodiment of modular multisize bidirectional scraping device shown in FIG. 1.
Figure 3:
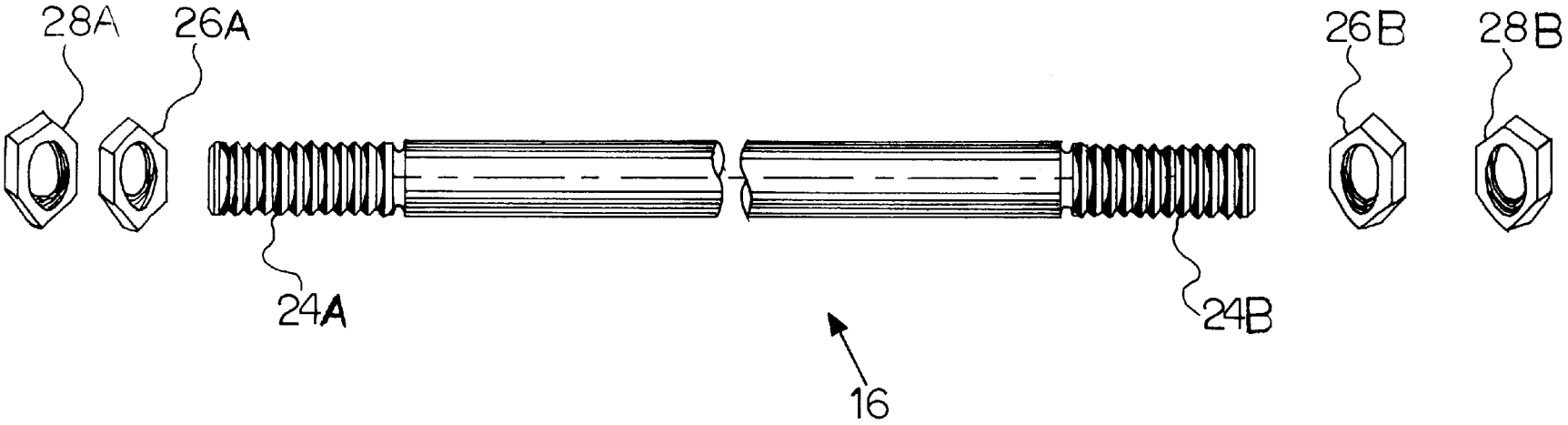
FIG. 3 is a side elevational view of the flexible shaft of the embodiment of modular multisize bidirectional scraping device shown in FIGS. 1 and 2.

FIGS. 1, 2 and 3 show one embodiment of a modular multisize bidirectional scraping device 10 of the present invention, and they illustrate details of the assembly of the device and its flexible shaft 16.

The modular multisize bidirectional scraping device 10 basically comprises a flexible shaft 16, a first flexible sealing module 12A fitted at a first end of the flexible shaft 16, a second flexible sealing module 12B fitted at a second end of the flexible shaft 16, and a plurality of groups of flexible radial scraping bars 14 therebetween. In the present embodiment, the flexible shaft 16 is composed of a steel cable, but other flexible materials may be used. The groups of flexible radial scraping bars 14 are manufactured from a flexible material, preferably polyurethane.

Figure 4:
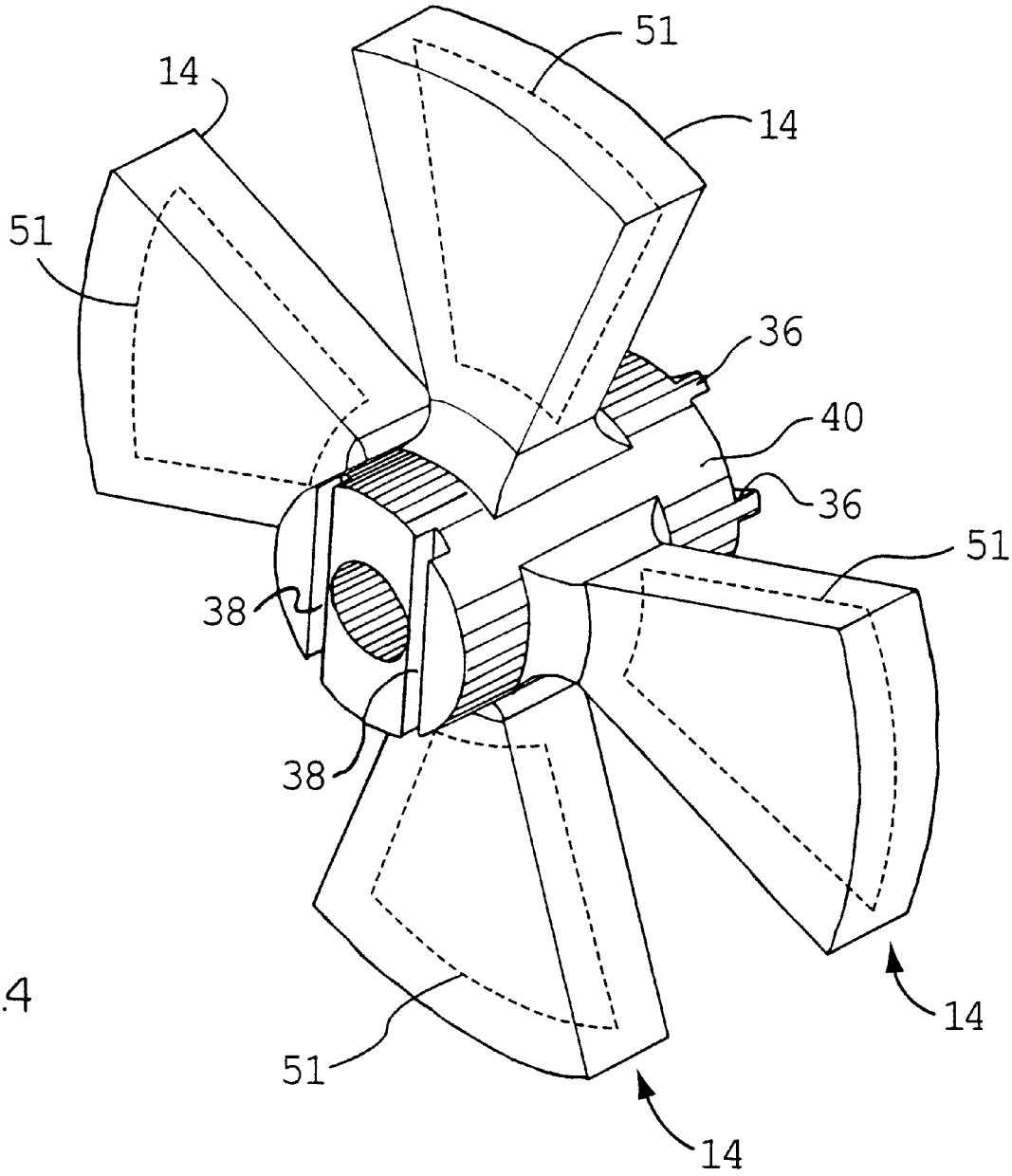
FIG. 4 is a perspective view of a group of flexible radial scraping bars of the modular multisize bidirectional scraping device of FIGS. 1 and 2.

FIG. 4 shows, in detail, a perspective view of one group of flexible radial scraping bars 14. It is possible to see a hub 40, to which the flexible radial scraping bars 14 are connected. In the present embodiment, the hub 40 and the flexible radial scraping bars 14 are of integral construction, but they may consist of distinct elements which are secured together in some way. In this second possibility, the groups of flexible radial scraping bars 14 must be secured to the hub 40 in a secure manner, guaranteeing that the scraping bars 14 will not become detached when the modular multisize bidirectional scraping device 10 passes through the inside of a pipeline.

FIG. 3 shows the flexible shaft 16 in greater detail. It is possible to see that, at each end of this shaft, there is a threaded end 24A, 24B, each one of these intended to receive both a nut 26A, 26B and a lock nut 28A, 28B. Simply to make it easier to see the nuts 26A, 26B and the lock nuts 28A, 28B, they are shown in the Figure to the side of the threaded ends 24A, 24B rather than threaded on the shaft.

FIG. 2 shows details of an embodiment of the modular multisize bidirectional scraping device 10 already assembled. An assembly sequence for this embodiment is described below.

Initially, a first nut 26A is threaded onto a first threaded end 24A of the flexible shaft 16 so that it functions as a buffer for a first spacer disc 30A, which is then assemble onto the flexible shaft 16 from the opposite end 24B until it abuts against this nut 26A. A first flexible sealing module 12A is then slipped onto the flexible shaft 16, again starting from the end 24B.

Next, a first stop disc 20A is slipped on and this is followed by the required number of groups of flexible radial scraping bars 14. The next step is the application of a second stop disc 20B, and then a second flexible sealing module 12B is slipped on the shaft. Next, a second spacer disc 30B is slipped on, and thereafter a second nut 26B is threaded onto the second threaded end 24B until it abuts against the second spacer disc 30B.

Finally, the two lock nuts 28A, 28B are threaded onto the respective threaded ends 24A, 24B. Obviously, the length of the flexible shaft 16 is such that it allows the nuts 26A, 26B and lock nuts 28A, 28B to exert a moderate degree of compression on the entire assembled whole, so as to prevent linear movement of the components relative to the shaft 16.

Clearly, of course, this is only one of the many possible ways in which to assemble a modular multisize bidirectional scraping device of the present invention, and the above description of the assembly sequence may not in any way be regarded as limiting the invention. Similarly, some components may be omitted or, alternatively, may be grouped together to form a single component.

As may be seen in FIG. 1, the groups of flexible radial scraping bars 14 are spaced along the flexible shaft 16 and are offset angularly relative to one another, for reasons which will be elaborated upon below. In the present embodiment, purely by way of illustrative example, use is made of two of the groups of flexible radial scraping bars 14, each containing four flexible radial scraping bars 14, this number of four flexible radial scraping bars per group is not a limitation, as any other number of flexible radial scraping bars may be used.

The flexible sealing modules 12A, 12B have radial dimensions such that, when the modular multisize bidirectional scraping device 10 is inserted into a pipeline; the flexible sealing modules 12A, 12B create a sealing effect, i.e. they are compressed against the inner walls of the pipeline through which the modular multisize bidirectional scraping device 10 is passing.

Consequently, when the modular multisize bidirectional scraping device 10 is inserted inside a pipeline, the seal promoted by the flexible sealing modules 12A, 12B causes the flow of fluid along the pipeline to push the modular multisize bidirectional scraping device 10, moving it through the inside of the pipeline.

In the present configuration, the flexible sealing modules 12A, 12B are shaped so that they have; alternately, channels 42 and sealing ribs 43, as shown in FIGS. 1 and 2. While the modular multisize bidirectional scraping device 10 is passing through a section of the pipeline in which, for example, there is a reduction in diameter, the flexible sealing modules 12A, 12B become deformed so as to be able to adapt their shape to the new diameter such that the sealing ribs 43 of the modules expand laterally in the direction indicated by the arrows A—A (FIG. 1) to fill in the empty gaps defined by the channels 42.

It is suggested that the flexible sealing modules 12A, 12B be formed from expanded polyurethane foam so as they can be used in the way just described.

Figure 2A:
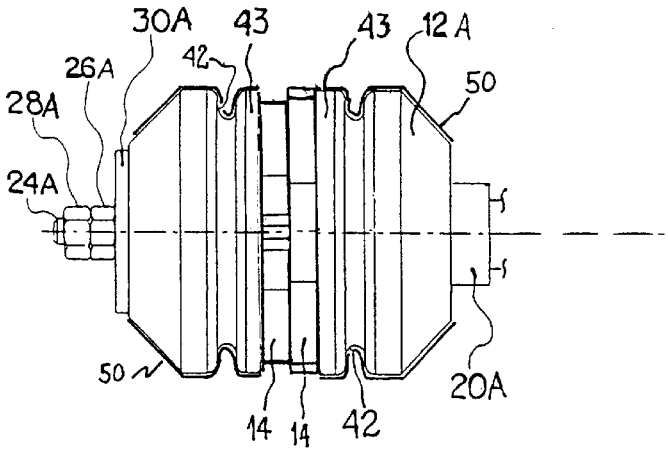
FIG. 2A shows a modified sealing module wherein groups of flexible radial scraping bars are fitted inside a flexible sealing module.

As the wear on each of the flexible sealing modules 12A, 12B is significant, a thin layer of elastomeric material 50 with high abrasion resistance, for example polyurethane, may be deposited on its outer surface which contacts the pipe wall, as shown in FIG. 2 and FIG. 2A, as a way in which to lengthen its service life.

The number of channels 42 and sealing ribs 43 in each flexible sealing module 12A, 12B will be defined in accordance with the characteristics of the pipeline in which the modular multisize bidirectional scraping device 10 will be used because in order that the channels 42 and sealing ribs 43 can be used in the way just described, it is necessary to carry out a preliminary study to consider, amongst other characteristics, the type of material used in the flexible sealing modules 12A, 12B and the degree of reduction in diameter of the pipeline. However, it should be pointed out that the flexible sealing modules 12A, 12B may also be used without the channels 42 and sealing ribs 43.

To prevent-the flexible sealing modules 12A, 12B being subjected to undesired longitudinal deformations when the modular multisize bidirectional scraping device 10 is passing through the inside of a pipeline, use may be made of some,type of longitudinal length limiter fitted inside each flexible sealing module 12A, 12B.

Figure 5:
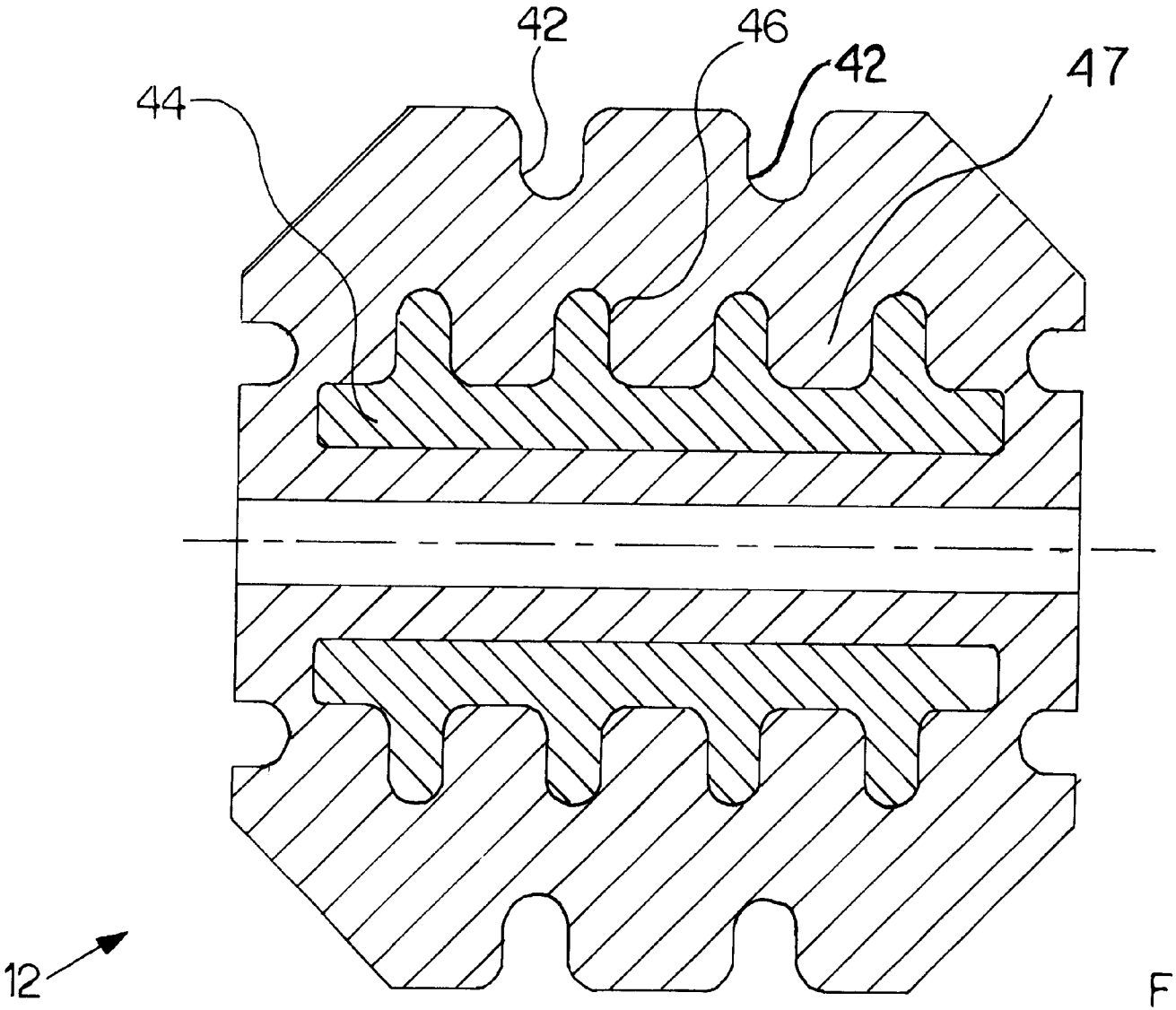
FIG. 5 is a view, in longitudinal section, of a flexible sealing module of the embodiment of modular multisize bidirectional scraping device shown in FIGS. 1 and 2.

FIG. 5 shows in longitudinal section a flexible sealing module 12A, 12B which, in the present embodiment, has a longitudinal movement limiter 44 embedded inside it in order to prevent the length of the flexible sealing module reducing, principally during deformation of the modular multisize bidirectional scraping device when it passes from a larger diameter to a smaller diameter inside a pipeline. The longitudinal movement limiter 44 has ribs 46 so that it fits together better with the flexible sealing module 12A, 12B. As may be seen in FIG. 5, each flexible sealing module 12A, 12B has radially inwardly extending ribs 47 which fit into the channels formed between the radially outwardly extending ribs 46 of the longitudinal movement limiter 44, guaranteeing a perfect fit between the longitudinal movement limiter 44 and the respective flexible sealing module 12A, 12B.

The longitudinal movement limiter 44 may be manufactured from either flexible or relatively rigid materials. When such a relatively rigid material is used, the longitudinal movement limiter 44 must have a total length which is less than the length of the flexible sealing module 12A or 12B so that the flexible sealing module 12A, 12B which contains it can easily pass through, for example, curved sections of a pipeline.

The longitudinal movement limiter 44 is not limited to the form presented nor to the number of ribs 46 shown in FIG. 5. For example, it is possible, for example, to provide it with helical ribs.

The material adhering to the inner walls of the pipeline is scraped off by the flexible radial scraping bars 14. As mentioned above, and as shown in FIG. 2, the groups of flexible radial scraping bars 14 are spaced apart and are offset angularly. The groups of flexible radial scraping bars 14 are fitted in this way so that substantially the entire circumference of the inner wall of a pipeline through which the modular multisize bidirectional scraping device 10 passes is subjected to the scraping effect.

In other words, when the modular multisize bidirectional scraping device 10 has passed through the inside of a specific length of a pipeline equivalent to the length of the modular multisize bidirectional scraping device 10, the arrangement of the groups of flexible radial scraping bars 14 guarantees that substantially the entire inner wall of the said section of pipeline will be scraped by at least one flexible radial scraping bar 14; this requires that the flexible radial scraping bars 14 are arranged in such a manner that the projection of the tips of the bars on a plane perpendicular to the axis of the shaft 16 substantially covers 360° of arc.

In order for the groups of flexible radial scraping bars 14 to be fitted in the angularly offset manner described above, means must be provided to guarantee this offsetting. For example, as shown in FIG. 4, in the present embodiment the groups of flexible radial scraping bars 14 are fitted on a hub 40 which has projections 36 on one of the end faces and notches 38 on the opposite end face, the notches 38 being angularly off set with respect to the projections 36.

This offsetting between the projections 36 and the notches 38 is predetermined so that, at the time of assembly of two or more hubs 40 with such an arrangement, the projections 36 of one group of flexible radial scraping bars 14 are suitably fitted into the notches 38 of an adjacent group of flexible radial scraping bars 14, thereby guaranteeing the desired angular offsetting of the hubs and consequently of the groups of flexible radial scraping bars 14 if the hubs all have an identical orientation of their scraping bars relative to the orientation of their projections 36 and notches 38. In addition to this, this type of assembly prevents undesirable relative rotational movements between the groups of flexible radial scraping bars 14, in use, which could alter the relative positions of the flexible radial scraping bars 14 and consequently adversely affect the scraping effect.

It should be pointed out that the means described above is only one of the many possible ways in which to assemble the groups of flexible radial scraping bars 14 in an angularly offset manner and this description was given only for descriptive purposes and may in no way be regarded as limiting the invention, since other means may be used to obtain the same result. For example, use may be made of an assembly of groups of flexible radial scraping bars 14 which is of integral construction.

When the modular multisize bidirectional scraping device 10 is inserted inside a pipeline, it is pushed along by the actual flow of fluid, as mentioned above. As the pipeline diameter is chosen to be smaller than the external diameter of the modular multisize bidirectional scraping device 10, the flexible sealing modules 12A, 12B are compressed and the radial scraping bars 14 are forced to bend in the direction opposite to the direction of movement. The resilience of the flexible radial scraping bars causes them to tend to seek their original orthogonal position, thereby forcing them against the inner walls of the pipeline. In this way, the desired scraping effect is enhanced.

The materials of the flexible sealing modules 12A, 12B, of the flexible radial scraping bars 14, and of the flexible shaft 16, should be relatively flexible and consequently the modular multisize bidirectional scraping device 10 can easily pass through the inside of pipelines, the internal diameter of which is substantially less than its external diameter, and through the inside of curved sections or other uneven sections.

As the two ends of the modular multisize bidirectional scraping device 10 are identical in shape, the device may be inserted inside a pipeline with either of its two ends facing forwards. In this way, if the modular multisize bidirectional scraping device 10 becomes caught inside a pipeline, it will suffice to reverse the direction of flow so that the device then moves in a direction which is the opposite of the direction in which it was originally launched, which will facilitate its recovery at the launching point, or at any other place suitable for this purpose.

It should be noted that, owing to the high degree of sealing on the part of the flexible sealing modules 12A, 12B, it is possible for the modular multisize bidirectional scraping device 10 to operate with only one of the two flexible sealing modules 12A, 12B since, even in this configuration, it will maintain its characteristics of scraping and of being bidirectional. In such situations, the single flexible sealing module may be located at any position along the flexible shaft 16.

The flexible radial scraping bars 14 may be stiffened by using, inside them, metallic materials 51 which have a characteristic known as "shape memory". These are materials which, after undergoing deformation, tend to return to their original shape, recovering their mechanical characteristics. In this way, the scraping effect of the flexible radial scraping bars 14 is enhanced.

To enhance the scraping effect of the modular multisize bidirectional scraping device 10 still further it is possible, as an alternative, to fit groups of flexible radial scraping bars 14 inside the flexible sealing modules 12A, 12B, as shown in FIG. 2A.

As shown in FIG. 1, a magnet 52 may also be placed at some point on the modular multisize bidirectional scraping device 10, which will allow the use of equipment to detect the passage of the said modular multisize bidirectional scraping device 10 inside the pipeline. For the purposes of simplification, a description of the process whereby the passage of the modular multisize bidirectional scraping device 10 is detected inside a specific point of a pipeline will not be described here as it does not form an integral part of the present invention and is also known to a large number of specialists.

The modular construction of the device of the present invention enables it to be reused an indefinite number of times since, if any component should be damaged, it will suffice to replace it with a new one, the others remaining in use.

Those who are expert in the field will appreciate that alterations and substitutions may be made without departing from the basic concepts described herein and the description given above of the embodiments of the modular multisize bidirectional scraping device should not be regarded as limiting the invention, which is limited only by the scope of the appended claims.

What is claimed is:

1. A bidirectional scraping device for use in removing material adhering to the inner walls of a pipeline, said device being moved inside the pipeline, in use, by means of the actual flow of the fluid flowing through the pipeline, wherein said device is of modular construction and comprises:

a plurality of groups of flexible radial scraping bars which are spaced apart and offset angularly so that the bars are able to scrape substantially the entire inner surface of the said pipeline;

a flexible shaft onto which said plurality of groups of flexible radial scraping bars is assembled; and at least one flexible sealing module fitted on said flexible shaft, wherein each flexible sealing module has channels and sealing ribs so that the sealing ribs can expand laterally and consequently fill in the empty gaps defined by the channels when the scraping device passes through a section of the pipeline in which there is a reduction in diameter.

2. Device according to claim 1, wherein said at least one sealing module comprises a first sealing module fitted at a first end of said flexible shaft, and a second flexible sealing module fitted at a second end of said flexible shaft, said flexible shaft having means for facilitating assembly and means for preventing, after assembly, the occurrence of linear movements between components.

3. Device according to claim 2, wherein said means for facilitating assembly comprise stop discs and spacer discs; and wherein the means for preventing, after assembly, the occurrence of linear movements between the components comprise a thread at each end of the flexible shaft, and a nut and lock nut which are threaded onto the respective threaded end for exerting compression so as to prevent linear movement of the components relative to said shaft.

4. Device according to claim 1, wherein said groups of flexible radial scraping bars have means for fitting of said groups of flexible radial scraping bars angularly offset from one another along said shaft.

5. Device according to claim 1, wherein said flexible radial scraping bars have, inside them, metallic materials with a shape-memory characteristic, in order to enhance their scraping effect.

6. Device according to claim 1, wherein a magnet is placed at a point of the device, to make the detection of the passage of the scraping device inside a pipeline possible.

7. Device according to claim 1, wherein each flexible sealing module has a thin layer of abrasion-resistant elastomeric material coating that surface which comes into direct contact with the inner walls of the pipeline.

8. A bidirectional scraping device for use in removing material adhering to the inner walls of a pipeline, said device being moved inside the pipeline, in use, by means of the actual flow of the fluid flowing through the pipeline, wherein said device is of modular construction and comprises:

a plurality of groups of flexible radial scraping bars which are spaced apart and offset angularly so that the bars are able to scrape substantially the entire inner surface of the said pipeline;

a flexible shaft onto which said plurality of groups of flexible radial scraping bars is assembled; and at least one flexible sealing module fitted on said flexible shaft, wherein each flexible sealing module had a thin layer of abrasion-resistant elastomeric material coating that surface which comes into direct contact with the inner walls of the pipeline.

9. Device according to claim 8, wherein each flexible sealing module has channels and sealing ribs so that the sealing ribs can expand laterally and consequently fill in the empty gaps defined by the channels when the scraping device passes through a section of the pipeline in which there is a reduction in diameter; and wherein there is a longitudinal movement inside each flexible sealing module in order to ensure it maintains a constant length.

10. Device according to claim 9, wherein the said longitudinal movement limiter has ribs for better gripping of the flexible sealing module.

11. Device according to claim 9, wherein the said flexible radial scraping bars have, inside them, metallic materials with a shape-memory characteristic, in order to enhance their scraping effect.

12. Device according to claim 11, wherein groups of further flexible radial scraping bars are fitted inside each flexible sealing module to enhance the scraping effect.

13. Device according to claim 9, wherein a magnet is placed at a point of the device, to make the detection of the passage of the scraping device inside a pipeline possible.

14. Device according to claim 8, wherein said flexible radial scraping bars have, inside them, metallic materials with a shape-memory characteristic, in order to enhance their scraping effect.

15. Device according to claim 14, wherein groups of further flexible radial scraping bars are fitted inside each flexible sealing module to enhance the scraping effect.

16. Device according to claim 8, wherein groups of further flexible radial scraping bars are fitted inside each flexible sealing module to enhance the scraping effect.

17. Device according to claim 16, wherein a magnet is placed at a point of the device, to make the detection of the passage of the scraping device inside a pipeline possible.

18. A bidirectional scraping device for use in removing material adhering to the inner walls of a pipeline, said device being moved inside the pipeline, in use, by means of the actual flow of the fluid flowing through the pipeline, wherein said device is of modular construction and comprises:

a plurality of groups of flexible radial scraping bars which are spaced apart and offset angularly so that the bars are able to scrape substantially the entire inner surface of the said pipeline;

a flexible shaft onto which said plurality of groups of flexible radial scraping bars is assembled; and at least one flexible sealing module fitted on said flexible shaft, wherein there is a longitudinal movement limiter inside each flexible sealing module in order to ensure it maintains a constant length.

19. Device according to claim 18, wherein said longitudinal movement limiter has ribs for better gripping of the flexible sealing module.

20. A bidirectional scraping device for use in removing material adhering to the inner walls of a pipeline, said device being moved inside the pipeline, in use, by means of the actual flow of the fluid flowing through the pipeline, wherein said device is of modular construction and comprises:

a plurality of groups of flexible radial scraping bars which are spaced apart and offset angularly so that the bars are able to scrape substantially the entire inner surface of the said pipeline;

a flexible shaft onto which said plurality of groups of flexible radial scraping bars is assembled; and at least one flexible sealing module fitted on said flexible shaft, wherein groups of further flexible radial scraping bars are fitted inside each flexible sealing module to enhance the scraping effect.

21. A bidirectional scraping device for use in removing material adhering to the inner walls of a pipeline, said device being moved inside the pipeline, in use, by means of the actual flow of the fluid flowing through the pipeline, wherein said device is of modular construction and comprises:

a plurality of groups of flexible radial scraping bars which are spaced apart and offset angularly so that the bars are able to scrape substantially the entire inner surface of the said pipeline;

a flexible shaft onto which said plurality of groups of flexible radial scraping bars is assembled; and at least one flexible sealing module fitted on said flexible shaft, wherein said at least one sealing module comprises a first sealing module fitted at a first end of said flexible shaft, and a second flexible sealing module fitted at a second end of said flexible shaft, said flexible shaft having means for facilitating assembly and means for preventing, after assembly, the occurrence of linear movements between components, wherein said means for facilitating assembly comprise stop discs and spacer discs; and wherein the means for preventing, after assembly, the occurrence of linear movements between the components comprise a thread at each end of the flexible shaft, and a nut and lock nut which are threaded onto the respective threaded end for exerting compression so as to prevent linear movement of the components relative to said shaft.

* * * * *